US006146208A

United States Patent [19]

Pennell

[11] Patent Number: 6,146,208

[45] Date of Patent: Nov. 14, 2000

[54] FIELD CONNECTOR ADAPTOR

[75] Inventor: Timothy M Pennell, Hickory, N.C.

[73] Assignee: CommScope, Hickory, N.C.

[21] Appl. No.: 08/877,193

[22] Filed: Jun. 17, 1997

[51] Int. Cl.[7] ..... H01R 24/00

[52] U.S. Cl. ..... 439/675; 439/578

[58] Field of Search ..... 439/578, 863, 439/584, 502, 323, 89, 758, 675, 654, 583

[56] References Cited

U.S. PATENT DOCUMENTS

| | | | |
|---|---|---|---|
| 3,550,064 | 12/1970 | Caller et al. | 439/583 |
| 3,694,793 | 9/1972 | Concelman | 439/358 |
| 3,879,102 | 4/1975 | Horak | 439/89 |
| 3,953,098 | 4/1976 | Avery et al. | 439/258 |
| 4,180,302 | 12/1979 | Gordon . | |
| 4,218,110 | 8/1980 | Giannaula et al. | 439/323 |
| 4,305,638 | 12/1981 | Hutter | 439/583 |
| 4,355,857 | 10/1982 | Hayward | 439/578 |
| 4,687,279 | 8/1987 | Holland et al. | 439/578 |
| 4,759,722 | 7/1988 | Song | 439/394 |
| 4,761,146 | 8/1988 | Sohoel | 439/584 |
| 4,842,553 | 6/1989 | Ingram | 439/583 |
| 4,925,403 | 5/1990 | Zorzy | 439/578 |
| 4,936,800 | 6/1990 | Couper et al. | 439/863 |
| 4,964,809 | 10/1990 | Jobson | 439/357 |
| 4,981,445 | 1/1991 | Bacher et al. | 439/578 |
| 5,122,070 | 6/1992 | Lebris et al. | 439/140 |
| 5,141,451 | 8/1992 | Down . | |
| 5,259,790 | 11/1993 | Hayward . | |
| 5,273,444 | 12/1993 | Down et al. . | |
| 5,295,863 | 3/1994 | Cady | 439/578 |
| 5,393,246 | 2/1995 | Du . | |
| 5,439,386 | 8/1995 | Ellis et al. | 439/578 |
| 5,575,690 | 11/1996 | Eaton . | |
| 5,667,409 | 9/1997 | Wong et al. | 439/654 |
| 5,863,226 | 1/1999 | Lan et al. | 439/654 |

*Primary Examiner*—Paula Bradley
*Assistant Examiner*—Antoine Ngandjui
*Attorney, Agent, or Firm*—Millen, White, Zelano & Branigan, P.C.

[57] ABSTRACT

An adaptor is provided for facilitating testing a coaxial cable connector assembly in the field with a test connector, wherein the coaxial cable connector assembly has a projecting pin of a selected length. The adaptor comprises a tubular member having a first end and a second end. The first end receives the coaxial cable connector assembly and the second end is for mounting the test connector. The first and second ends are joined by a bore which extends from the first end to the second end with the bore having a length at least as long as the pin.

10 Claims, 2 Drawing Sheets

FIELD CONNECTOR ADAPTOR

BACKGROUND OF INVENTION

This invention relates to the installation of coaxial cable in the ground or otherwise in a cable network system.

More particularly, this invention relates to connector adaptors utilizable in the field to test such installation. It is necessary at stages during the installation process, especially at the end of the process, to perform quality control tests and confirm the integrity of the system that has been installed. To check that the signals are properly passing through the cable, installers use a test connector to press onto the end of the coaxial cable being installed. These test connectors are designed to pass the signal from a device through the cable and confirm that the installation caused no damage to the cable.

One of the most widely used types of test connectors is called a push-on test connector. In a push-on test connector assembly, the connector is merely pushed onto the square cut end of a coaxial cable. Positive pressure devices maintain electrical continuity at points of contact between the outer conductor of the cable undergoing tests and that of the test connector assembly and between the inner conductor of the cable and that of the test connector assembly. One type of push-on test connector is referred to as a "pogo" test connector. A pogo test connector has a resilient spring contact probe that is adapted at the center conductor of the push-on connector assembly and provides positive contact between the center conductor of the cable and the center conductor of the push-on test connector assembly. The pogo type test connector is described in U.S. Pat. No. 4,355,857. The pogo type test connector is easy and convenient to use on the square cut end of coaxial cable. All that is required is different size test connectors to test different diameter coaxial cable products.

Once a cable has been installed, a conventional cable connector is secured to the end of the cable. Cable connectors are typically uniform so that standard components may be used in the installation of a system. One of the standard attributes of a cable connector is a pin extending from the middle of the connector that carries the signals from the center conductor of the coaxial cable. The pin extends from the connector a standard length depending on the size and manufacturer of the cable connector. Once the cable connector is mounted on the cable, then a push-on test connector such as the pogo test connector cannot be used to test the cable. In order to test the cable with the field connector, the pin must be trimmed and an adaptor installed or the connector removed and the cable prepared for a push on test connector. The above action will destroy the connector for installation or cause excessive installation time repairing the cable and reinstalling the field connector.

SUMMARY OF THE INVENTION

It is an object of the present invention to provide an adaptor that is attachable to a cable connector that will allow use of a push on test connector without damaging or altering the cable connector. The foregoing and further and more specific objects and advantages of the disclosed invention will become readily apparent to those skilled in the art from the following detailed description of the preferred embodiment taken in conjunction with the drawings and appended claims.

The invention is directed to an adaptor for facilitating testing a coaxial cable connector assembly with a test connector wherein the coaxial cable connector assembly has a projecting pin of a selected length. The adaptor comprises a tubular member having a first end and a second end. The first end receives the coaxial cable connector assembly, and the second end is for mounting the test connector. The first and second ends are joined by a bore which extends from the first end to the second end with the bore having a length at least as long as the pin.

In a further aspect, the invention comprises a field connector adaptor for use by persons installing cable systems. It is envisioned that there will be several different field connector adaptors for all the different standard sizes of cable connector assemblies that are commercially available. The field connector adaptor comprises a tubular member comprising a first end and a second end. The first end comprises a coupling for securing the tubular member to a coaxial cable connector assembly having a pin extending from it. Typically, the first end is threaded so that the tubular member may be screwed onto the end of the cable connector. The second end of the tubular member has a predetermined outside diameter adopted for insertion into a test connector. The length of the tubular member is preselected wherein the pin extending from the coaxial cable connector assembly extends through substantially the entire length of the tubular member when the tubular member is secured to the cable connector assembly. As a result of the foregoing, a test connector may be used without having to trim or remove the pin from a coaxial cable connector assembly previously mounted on the end of the coaxial cable.

The field connector adaptor may also include an annular insert that is placed inside the second end of the tubular member. The insert receives the pin extending from the coaxial cable connector assembly. The annular insert may be comprised of a dielectric material, for instance, teflon. The annular insert is able to support the pin and fix it so that it is in the center of the second end of the adaptor and insulated from the tubular member. In this way, a test connector easily comes into contact with the pin carrying the signal from the center conductor for evaluating the electrical integrity of the cable system. To assist with guiding the pin into the annular insert, the insert is tapered from an inside end to an outside end for guiding the pin through the insert.

DETAILED DESCRIPTION OF THE PREFERRED EMBODIMENT

Figure 1:
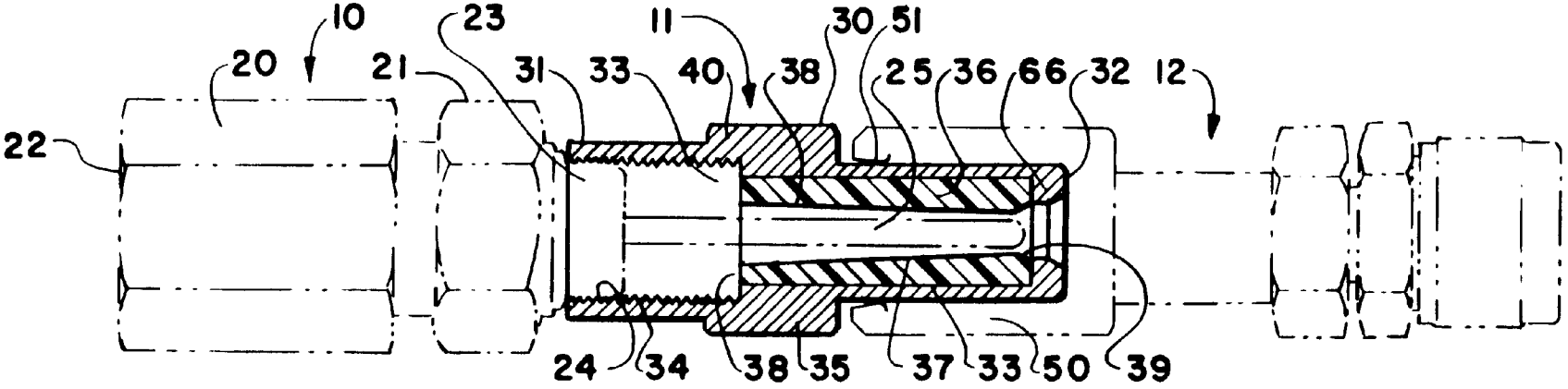
FIG. 1 is a cross-sectional view of the adaptor showing the manner in which a cable connector and test connector fit onto the adaptor.

Referring first to FIG. 1, there is seen a conventional cable connector assembly 10, an adaptor 11 and a conventional test connector 12. The cable connector assembly 10 and test connector 12 are shown in broken lines, because they are illustrated only to show how they fit together and work with the adaptor 11.

The coaxial cable connector assembly 10 includes a generally tubular outer body 20 fabricated of an electrically conductive material, usually a metal, such as aluminum or brass. A connector nut 21 is formed on a intermediate portion of the body for facilitating rotation of the cable connector assembly 10 when connecting it to a selected device. The body 20 includes a proximal end 22 provided with first fastening means (not shown), such as external threads, for securing the connector assembly 10 to the end of a coaxial cable (not shown), and a distal end 23 provided with second fastening means 24, such as external threads, for securing the connector assembly 10 to any device. In this illustration, the external threads of the second fastening means 24 secure the connector assembly 10 to the adaptor 11. A central conductor pin 25 is carried coaxially within the outer body 20 of the cable connector assembly 10. The pin 25 is made of electrically conductive material and is insulated from the body 20.

The adaptor 11 comprises a tubular member 30 having a first end 31 and a second end 32. The first end 31 receives the cable connector assembly 10. The first and second ends 31 and 32, respectively, are joined by a first bore 33 that extends from the first end 31 to the second end 32. The first end 31 comprises a female coupling element 34 for receiving the second fastening means 24 of the cable connector assembly 10 and provides electrical continuity between the coaxial cable outer conductor (not shown) and the adaptor tubular member 30. The female coupling element 34 is shown as having internal threads for attachment to external threads on the cable connector assembly 10. An adaptor nut 35 is formed on an intermediate portion 40 of the tubular member 30 for facilitating rotation of the adaptor 11 to the cable connector assembly 10. The second end 32 of the tubular member 30 is for mounting the test connector 12. The second end 32 is a male coupling element for receipt in the test connector 12 and has the preselected outer diameter to properly fit into the test connector.

The second end 32 also comprises an annular insert 36. The annular insert 36 is comprised of a dielectric material. Preferably, the dielectric material is teflon, but other dielectric materials such as various plastics or ceramics may be equally effective. The annular insert 36 has a second bore 37 which extends all the way through it. The wall defining the second bore 37 forms a slight taper from the inside end 38 of the bore to the outside end 39 of the bore. The inside end 38 of the second bore 37 is in the intermediate portion 40 of the tubular member 30. The outside end 39 of the second bore 37 is at the second end 32 of the member 30.

The tubular member 30 is fabricated of an electrically conductive material, usually a metal, such as aluminum or brass. The length of the tubular member 30 is based on the length of the pin 25 extending from the cable connector assembly 10. That is, once the adaptor 11 is mounted onto the cable connector assembly 10, the pin 25 extends substantially through the tubular member 30 and through the second bore 37 of the dielectric insert 36 in the second end 32 of the tubular member 30. The insert 36 protects the pin 25 from coming into contact with the tubular member 30.

The push on connector 12 is provided with an annular, spring finger ferrule 50 which slidingly maintains a pressure contact with the second end 32 of the adaptor 11. This pressure contact between the spring fingers 51 of the ferrule 50 and the second end 32 of the adaptor 11 provides electrical continuity between the coaxial cable outer conductor and the ferrule 50 through the cable connector assembly 10 and the adaptor 11. The push-on connector also comprises a resilient spring contact probe (not shown) that is adapted at the center conductor of the push-on connector assembly 12 that provides positive contact between the center conductor of the pin 25 and center conductor of the push on test connector assembly.

Figure 2:
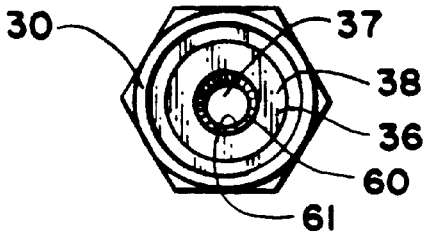
FIG. 2 is an end view of the first end of the adaptor.
Figure 3:
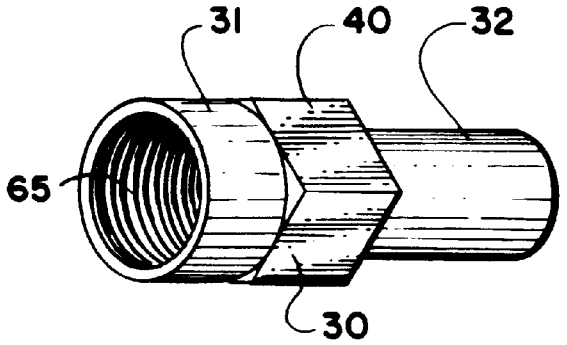
FIG. 3 is a perspective view taken in the direction of the first end of the adaptor.
Figure 4:
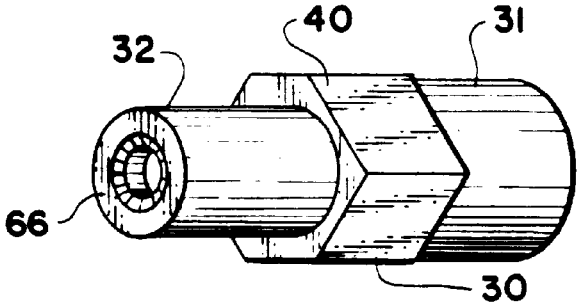
FIG. 4 is a perspective view taken in the direction of the second end of the adaptor.

FIGS. 2 through 4 provide other views of the adaptor. In FIG. 2, it is shown that the diameter opening 60 at the inside end 38 of the second bore 37 defined by the insert 36 is greater than the diameter opening 61 defined by the bore at the outside end 39 (see FIG. 1) of the insert 36. This tapered feature facilitates insertion of the pin 25 through the second bore 37 and guides the pin 25 so that it will be centered at the second end 32 of the adaptor 11. The inside end 38 of the insert 36 begins in the intermediate section 40 of the adaptor 11 and the insert 36 extends through to the second end 32 of the adaptor 11.

Turning now to FIG. 3, the first end 31 of the adaptor has internal threads 65 for attachment to a cable connector assembly. The specific inside diameter of the first end and the type of internal threads are preselected so as to be compatible with standard cable connector assemblies.

In FIG. 4, the second end 32 of the tubular member 30 is cylindrical in shape. The outside diameter of the second end 32 is predetermined and adopted for insertion into a test connector. At the second end 32 of the tubular member 30 there is a flange 66 that holds the insert in place in the second end 32 of the tubular body 30.

Since the adaptor of the invention may be readily screwed onto or unscrewed off of the cable connector assembly and readily pushed into or pulled from a test connector, the claimed adaptor is intended primarily for test purposes rather than for permanent installation although, those skilled in the art will readily conceive of adaptor devices for attaching the adaptor permanently to the cable connector assembly and/or the test connector.

A preferred embodiment of the invention has been disclosed. Those skilled in the art will conceive of other embodiments satisfying the same function and which will fall within the spirit and scope of the invention herein disclosed. It is intended that all such embodiments shall fall within the scope of protection provided by the claims attached hereto.

That which is claimed is:

1. A field connector adaptor comprising:

a tubular member comprising a first end and a second end and having a preselected length, the first end comprising a coupling for securing the tubular member to a coaxial cable connector assembly having a pin extending therefrom, the second end having a predetermined outside diameter wherein the second end is adapted for insertion into a test connector, the length of the tubular member being preselected wherein the pin extending from the coaxial cable connector assembly extends through substantially the entire length of the tubular member when the tubular member is secured to the coaxial cable connector assembly, whereby a coaxial cable may be tested using a test connector without having to trim or remove the pin from the coaxial cable connector assembly.

2. The field connector adaptor of claim 1 wherein the second end comprises an annular insert inside the second end for receiving the pin extending from the coaxial cable connector assembly.

3. The field connector adaptor of claim 2 wherein the annular insert is comprised of a dielectric material.

4. The field connector adaptor of claim 3 wherein the dielectric material is teflon.

5. The field connector adaptor of claim 3 wherein the annular insert has an inside end and an outside end and a bore which tapers from the inside end to the outside end for guiding the pin into the insert.

6. An adaptor for facilitating testing a coaxial cable connector assembly with a test connector, wherein the coaxial cable connector assembly has a projecting pin, the adaptor comprising:

a tubular member having a first end for receiving the coaxial cable connector assembly and a second end for mounting the test connector, the first and second ends being joined by a bore which extends from the first end to the second end, the bore having a length at least as long as the pin.

7. The adaptor of claim 6 wherein a bore defined by an annular insert of dielectric material tapers from the first end to the second end.

8. The adaptor of claim 7 wherein the first end is a female coupling element for receiving the coaxial cable connector assembly and the second end is a male coupling element for receipt in the test connector.

9. The adaptor of claim 6 wherein the first end is a female coupling element for receiving the coaxial cable connector assembly and the second end is a male coupling element for receipt in the test connector.

10. The adaptor of claim 9 wherein a bore defined by an annular insert of dielectric material tapers from the first end to the second end.

* * * * *